US011430279B2

(12) United States Patent
Beebe et al.

(10) Patent No.: US 11,430,279 B2
(45) Date of Patent: Aug. 30, 2022

(54) FUNCTIONALIZED MICROFLUIDIC DEVICE AND METHOD

(75) Inventors: David J. Beebe, Monona, WI (US); Erwin Berthler, Madison, WI (US); Peter Cavnar, Madison, WI (US); David John Guckenberger, Oconomowoc, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 498 days.

(21) Appl. No.: 13/467,599

(22) Filed: May 9, 2012

(65) Prior Publication Data

US 2013/0299041 A1 Nov. 14, 2013

(51) Int. Cl.

| | |
|---|---|
| ***B01L 3/00*** | (2006.01) |
| ***G07C 9/32*** | (2020.01) |
| ***B01L 3/02*** | (2006.01) |
| ***G07C 9/38*** | (2020.01) |

(52) U.S. Cl.

CPC ..... *G07C 9/32* (2020.01); *B01L 3/0293* (2013.01); *B01L 3/50273* (2013.01); *B01L 3/563* (2013.01); *G07C 9/38* (2020.01); *B01L 3/0255* (2013.01); *B01L 3/0262* (2013.01); *B01L 2200/16* (2013.01); *B01L 2300/047* (2013.01); *B01L 2300/0672* (2013.01); *B01L 2300/0816* (2013.01); *B01L 2400/024* (2013.01); *B01L 2400/0406* (2013.01); *B01L 2400/0481* (2013.01); *B01L 2400/0683* (2013.01); *G07C 2209/08* (2013.01)

(58) Field of Classification Search

CPC ..... B01L 2200/16; B65B 3/04

USPC ..... 422/507; 141/1

See application file for complete search history.

(56) References Cited

U.S. PATENT DOCUMENTS

| | | | | |
|---|---|---|---|---|
| 6,001,307 | A * | 12/1999 | Naka et al. | 422/81 |
| 6,322,683 | B1 | 11/2001 | Wolk et al. | |
| 7,470,403 | B2 | 12/2008 | Beebe et al. | |

(Continued)

FOREIGN PATENT DOCUMENTS

| | | | |
|---|---|---|---|
| EP | 1611954 | 1/2006 | |
| EP | 1611954 A1 * | 1/2006 | B01L 3/502715 |

(Continued)

OTHER PUBLICATIONS

Oxford Dictionary ("The Concise Oxford Dictionary," 10th ed., ed. Judy Pearsall, pub. Oxford University Press, New York, 1999, the definition of "slot," 4 pages).*

(Continued)

*Primary Examiner* — Patrick Orme

(74) *Attorney, Agent, or Firm* — Boyle Fredrickson, S.C.

(57) ABSTRACT

A microfluidic platform and method are provided. The microfluidic platform includes a base having an outer surface and a plurality of wells formed in the outer surface thereof for receiving fluid therein. The plurality of wells are in fluid communication with each other. A lid includes a plurality of channels having corresponding inputs and outputs. The lid is moveable between a first position wherein the lid is disengaged from the base and a second position wherein the inputs of each channel communicate with corresponding wells in the base. The fluid in each well is drawn into corresponding channels through the inputs thereof by capillary action.

6 Claims, 10 Drawing Sheets

(56) References Cited

U.S. PATENT DOCUMENTS

| | | | | |
|---|---|---|---|---|
| 7,824,616 | B2 * | 11/2010 | Katsuki et al. | 422/68.1 |
| 9,186,670 | B2 * | 11/2015 | Berthier | B01L 3/50853 |
| 9,475,049 | B2 * | 10/2016 | Siciliano | B01L 3/5023 |
| 2002/0114740 | A1 * | 8/2002 | Yamamoto | 422/100 |
| 2002/0168298 | A1 * | 11/2002 | Huhn | B01L 3/0268 422/506 |
| 2003/0124549 | A1 * | 7/2003 | Beutler | B01L 3/50853 435/6.11 |
| 2003/0215358 | A1 * | 11/2003 | Schulman et al. | 422/56 |
| 2005/0226779 | A1 | 10/2005 | Oldham et al. | |
| 2006/0002827 | A1 * | 1/2006 | Curcio | B01L 3/502715 422/400 |
| 2007/0253868 | A1 | 11/2007 | Beebe et al. | |
| 2008/0085219 | A1 * | 4/2008 | Beebe | B01F 5/104 422/400 |
| 2009/0098659 | A1 | 4/2009 | Abhyankar et al. | |
| 2009/0181411 | A1 * | 7/2009 | Battrell | B01F 11/0071 435/7.92 |
| 2009/0305326 | A1 | 12/2009 | Beebe et al. | |
| 2010/0304986 | A1 * | 12/2010 | Chen | B01L 3/502715 506/9 |
| 2012/0021529 | A1 | 1/2012 | Nachef et al. | |

FOREIGN PATENT DOCUMENTS

| | | | | |
|---|---|---|---|---|
| KR | 10-2005-0110810 | | 11/2005 | |
| KR | 10-2012-0040697 | | 4/2012 | |
| WO | 200161041 | | 8/2001 | |
| WO | 2010118427 | | 10/2010 | |
| WO | WO2010118427 | A1 * | 10/2010 | B01L 3/502715 |
| WO | WO-2010118427 | A1 * | 10/2010 | B01L 3/502715 |

OTHER PUBLICATIONS

Oxford Dictionary, "The Concise Oxford Dictionary," 10th ed., ed. Judy Pearsall, Oxford University Press, New York, 1999, 6 pages.*

Berthier et al., Lab Chip 13 (pub. Nov. 19, 2012) 424-431, 8 pages. (Year: 2012).*

U.S. Appl. No. 61/436,733, filed Jan. 27, 2011, 121 pages. (Year: 2011).*

EP 13788080.3-1371, Supplementary European Search Report, dated Mar. 8, 2016, 9 pages.

Berthier et al., "Kit-On-A-Lid Assays for accessible self-contained cell assays", Lab on a Chip, 2013, 13, 424.

EP 13 788 080.3-1101, European Communication, dated Feb. 13, 2018, 8 pages.

* cited by examiner

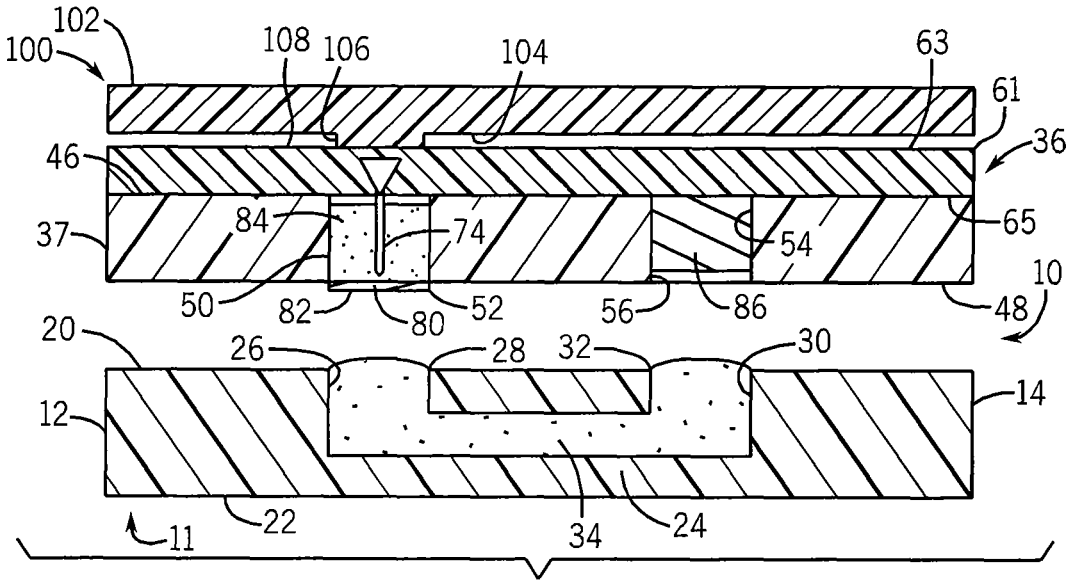
FIG. 2
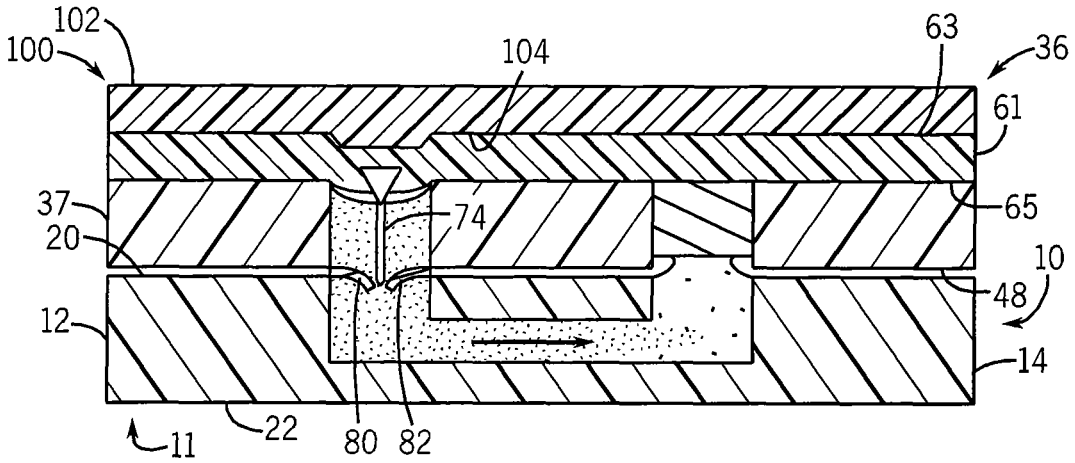
FIG. 3
FIG. 3a
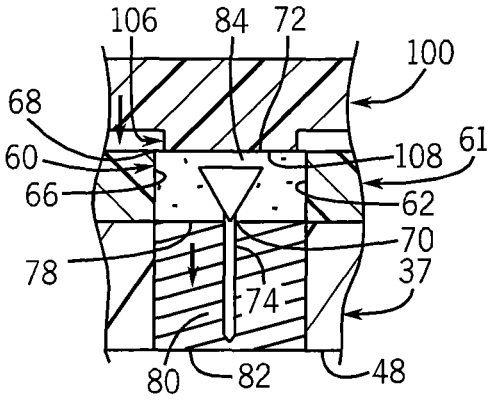

FUNCTIONALIZED MICROFLUIDIC DEVICE AND METHOD

REFERENCE TO GOVERNMENT GRANT

This invention was made with government support under CA137673 awarded by the National Institutes of Health. The government has certain rights in the invention.

FIELD OF THE INVENTION

This invention relates generally to microfluidic devices, and in particular, to a functionalized microfluidic device and method for handheld diagnostics, as well as, biological and chemical assays.

BACKGROUND AND SUMMARY OF THE INVENTION

The field of microfluidics has matured significantly over the past two decades. Compelling platforms have been produced to address problems in traditional cell biology techniques that were previously too difficult to solve. Limitations of traditional cell biology techniques have been primarily due to onerous labor requirements and limited spatial and temporal control of the cells' microenvironment. Microfluidics has provided significant efficiency gains by reducing reagent and cell requirements that, in turn, has allowed for high-throughput processing and analysis of a large array of experimental conditions. Microfluidic systems also offer significantly greater control of the cells' microenviroment, such as flow rate, extracellular matrix (ECM) properties, and soluble factor signaling (e.g., forming a chemical gradient in diffusion dominant conditions). However, for microfluidics to make further inroads into cell biology, new microfluidic assays must be cheaper, faster, and in qualitative agreement with techniques traditionally used by biologists. It can be appreciated that microfluidics has tremendous potential to contribute to the development of drug therapies to fight cancer, point-of-care diagnostics for HIV in developing countries, and numerous other applications that are critical to the health and well being of individuals worldwide.

While current microfluidic devices provide a significant improvement in the ability to study fundamental aspects of cell biology, the adoption of microfluidic devices in clinical settings has been slow due to the high level of technicality and external equipment required. For example, current microfluidic assay methods require steps such as washing, flushing, pipetting, and transferring of cells and other materials. As such, most conventional microfluidic devices typically incorporate external elements, such as tubing and syringe pumps, to provide the valving and the mixing functionality necessary to enable an entire assay to be performed within a microfluidic system. These external elements diminish the simplicity and advantages of a microfluidic platform for biological assays. Hence, it is highly desirable to provide a handheld, disposable microfluidic device capable of performing assays which does not require any external equipment to operate and which can be adapted to a wide range of situations.

Therefore, it is a primary object and feature of the present invention to provide a microfluidic device and a method for performing handheld diagnostics and assays which do not require any external equipment to operate and which can be adapted to a wide range of situations.

It is a further object and feature of the present invention to provide a microfluidic device and a method for performing diagnostics and assays which are handheld and disposable.

It is a still further object and feature of the present invention to provide a microfluidic device and a method for performing handheld diagnostics and assays which are simple to use and inexpensive to manufacture.

In accordance with the present invention, a microfluidic platform is provided. The microfluidic platform includes a base having outer surface and a well formed in the outer surface for receiving a fluid therein. A lid has a channel therethrough. The lid includes an input portion defining an input of the channel and an output portion defining an output of the channel. The lid is moveable between a first position wherein the lid is disengaged from the base and a second position wherein the input of the channel communicates with the fluid in the well. The fluid in the well is drawn into the channel by capillary action.

A removable membrane may be connected to the outer surface of the base so as to extend over the well and retain the fluid therein. The base includes a recess in the outer surface. The recess is adapted for receiving an absorbent therein. The output of the channel communicates with the absorbent with the lid in the second position.

The lid includes an outer surface and the output portion of the lid extends from the outer surface thereof. The output portion of the lid includes a passage therethrough. The passage has a first end defining the output of the channel and a second end communicating with the channel. The input portion of the lid also extends from the outer surface thereof and includes a passage therethrough. The passage has a first end defining the input of the channel and a second end communicating with the channel. It is contemplated for the input portion of the lid to define a post receivable in the well with the lid in the second position.

In accordance with a further aspect of the present invention, a microfluidic platform is provided. The microfluidic platform includes a base having an outer surface and a plurality of wells formed in the outer surface thereof for receiving fluid therein. The plurality of wells being in fluid communication. A lid includes a plurality of channels having corresponding inputs and outputs. The lid is moveable between a first position wherein the lid is disengaged from the base and a second position wherein the inputs of each channel communicate with corresponding wells in the base. The fluid in each well is drawn into corresponding channels through the inputs thereof.

A removable membrane may be connected to the outer surface of the base for retaining the fluid in the plurality of wells. The base may include a recess in the outer surface thereof. The recess is adapted for receiving an absorbent therein. The outputs of the plurality of channels communicate with the absorbent with the lid in the second position. The lid includes an outer surface and a plurality of output portions extending therefrom. Each output portion includes a passage therethrough having a first end defining the output of a corresponding channel and a second end communicating with the corresponding channel. The lid also includes a plurality of input portions extending from the outer surface thereof. Each input portion includes a passage therethrough having a first end defining the input of a corresponding channel and a second end communicating with the corresponding channel. Each input portion of the lid may define a post that is receivable in a corresponding well with the lid in the second position.

In accordance with a still further aspect of the present invention, a method is provided. The method includes the steps of providing a plurality of wells in a base and filling the plurality of wells with a fluid. A lid having a plurality of channels therein is moved from a first position wherein the lid is spaced from the base to a second position wherein the lid is adjacent the base such that each input of the plurality of channels communicates with a corresponding well in the base. Thereafter, fluid is drawn from the plurality of wells into the plurality of channels.

A removable membrane may be connected to the base so as to retain the fluid in the plurality of wells. The removable membrane is removed from the base prior to step of moving the lid from the first position to the second position. It is contemplated for the fluid to be drawn into the plurality of channels by capillary action. In addition, fluid flow in the plurality of channels may be induced by bringing an absorbent into contact with the plurality of channels. To facilitate filling of the plurality of wells with the fluid, the wells may be interconnected.

BRIEF DESCRIPTION OF THE DRAWINGS

The drawings furnished herewith illustrate a preferred construction of the present invention in which the above advantages and features are clearly disclosed as well as other which will be readily understood from the following description of the illustrated embodiment.

In the drawings:

FIG. 2 is a cross sectional view of the microfluidic device of FIG. 1 in a non-actuated position;

FIG. 3 is a cross sectional view of the microfluidic device of FIG. 2 in an actuated position;

FIG. 3*a* is an enlarged, cross sectional view of the microfluidic device, similar to FIG. 2, showing an alternate actuation mechanism;

DETAILED DESCRIPTION OF THE DRAWINGS

Figure 1:
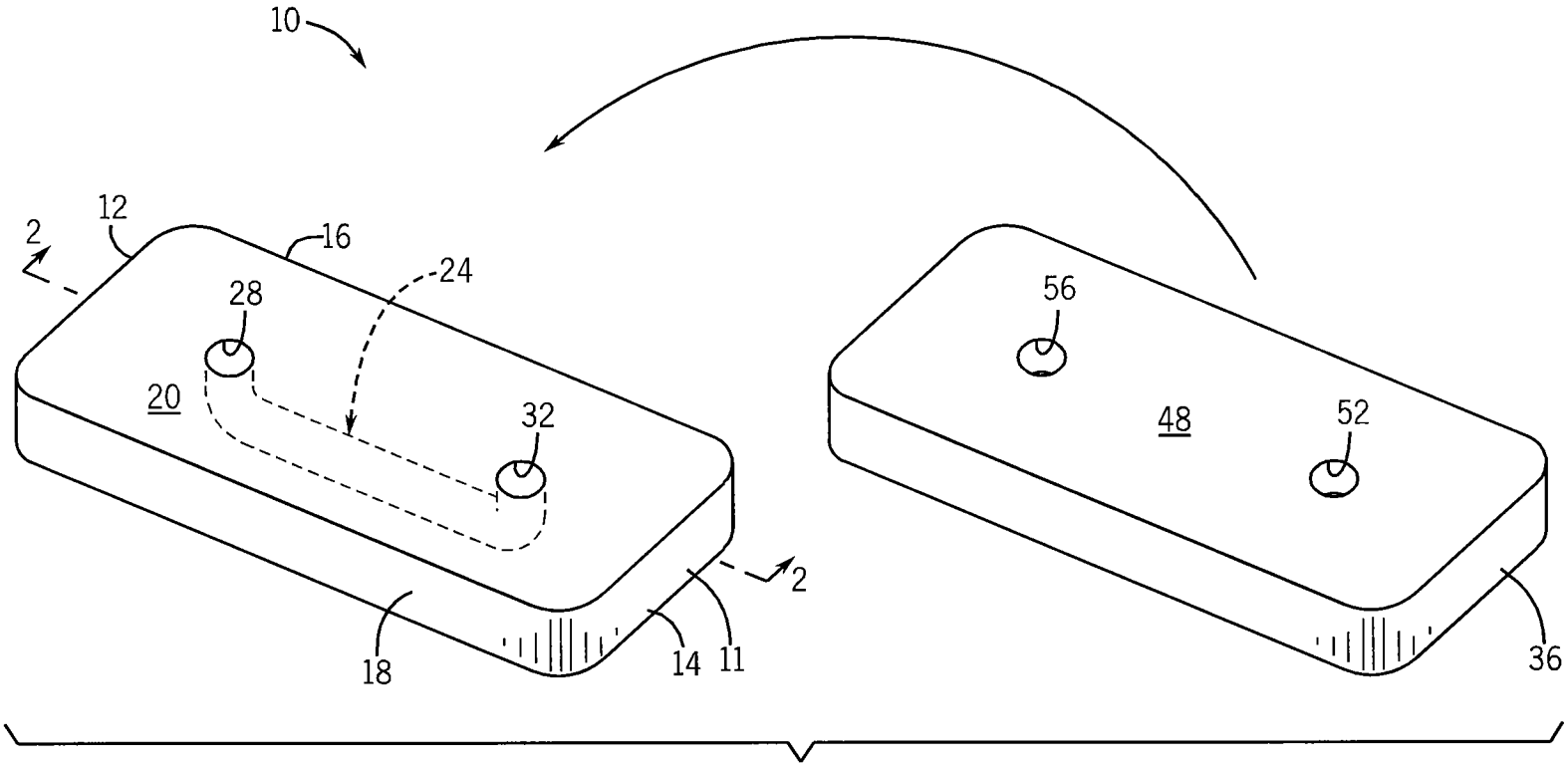
FIG. 1 is an exploded, isometric view of a microfluidic device in accordance with the present invention.

Referring to FIGS. 1-3, a microfluidic device in accordance with the present invention is generally designated by the reference numeral 10. Microfluidic device 10 may be formed from polystyrene (PS) or polydimethylsiloxane (PDMS), however, other materials are contemplated as being within the scope of the present invention. In the depicted embodiment, microfluidic device 10 includes base 11 having first and second ends 12 and 14, respectively; first and second sides 16 and 18, respectively; and upper and lower surfaces 20 and 22, respectively. Channel 24 extends through base 11 of microfluidic device 10 and includes a first vertical portion 26 terminating at an input port 28 that communicates with upper surface 20 of base 11 of microfluidic device 10 and a second vertical portion 30 terminating at an output port 32 also communicating with upper surface 20 of base 11 of microfluidic device 10. First and second vertical portions 26 and 30, respectively, of channel 24 are interconnected by and communicate with horizontal portion 34 of channel 24. The dimension of channel 34 connecting input port 28 and output port 32 is arbitrary.

Microfluidic device 10 further includes lid 36 having a first layer 37 with first and second ends; first and second sides; and upper and lower surfaces 46 and 48, respectively. Similar to base 11, first layer 37 may be formed from polystyrene (PS), however, other materials are contemplated as being within the scope of the present invention. First layer 37 of lid 36 further includes a first well 50 terminating at an output port 52 that communicates with lower surface 48 and a second well 54 terminating at an input port 56 communicating with lower surface 48. The diameter of output port 52 is generally equal to the diameter of input port 28 in base 11 and the diameter of input port 56 is generally equal to the diameter of output port 32 of base 11.

As best seen in FIGS. 2-3, it is contemplated to provide for lid 36 to further include a second layer 61 having an upper surface 63 and a lower surface 65 affixed to upper surface 46 of first layer 37. Second layer 61 further includes first and second ends aligned with correspond first and second ends of first layer 37; and first and second sides aligned with first and second sides of first layer 37. Second layer 61 may be formed from a flexible material, e.g., polydimethylsiloxane (PDMS), and includes needle 74 projecting from lower surface 65 thereof. Needle 74 terminates at terminal end 80 which is receivable in first well 50.

To facilitate actuation of device 10, lid 36 may include an enlarged cap 100 having first and second ends aligned with correspond first and second ends of first layer 37; first and second sides aligned with first and second sides of first layer 37; and upper and lower surfaces 102 and 104, respectively. Similar to base 11 and first layer 37, end cap 100 may be formed from polystyrene (PS), however, other materials are contemplated as being within the scope of the present invention. Actuation post 106 projects from lower surface 104 of end cap 100 and is axially aligned with first well 50 in first layer 37. It is intended for terminal end 108 of actuation post 106 to engage upper surface 67 of second layer 61. As described, end cap 100 is movable between a first non-actuated position wherein terminal end 80 of needle 74 is received in first well 50, FIG. 2, and a second, actuated position wherein terminal end 108 of actuation post 106 urges a plunger portion of second layer 61 downwardly in FIG. 3 such that terminal end 80 of needle 74 projects from first well 50.

Alternatively, FIG. 3*a*, second layer 61 may include passage 62 therethrough which is adapted for slideably receiving plunger 60 therein. By way of example, passage 62 has a generally cylindrical configuration having defined by wall 66. Wall 66 has an upper edge 68 which communicates with upper surface 63 of second layer 61 and a lower end 70 defining an opening which communicates with first well 50. Plunger 60 is defined by upper surface 72 and lower surface 78 interconnected by generally cylindrically outer surface 76 which forms a slidable interface with wall 66. Needle 74 projects from lower surface 78 of plunger 60. It is contemplated for plunger 60 to be movable between a first, unactuated position wherein upper surface 72 of plunger 60 is generally coplanar with upper surface 46 of lid 36 and terminal end 80 of needle 74 is received in first well 50 and a second, actuated position wherein upper surface 72 of plunger 60 is received in passage 62 and terminal end 80 of needle 74 projects from first well 50.

It can be appreciated that end cap 100 may be used to move plunger 60 between its unactuated and actuated positions. More specifically, end cap 100 may be positioned such that terminal end 108 of actuation post 106 engages upper surface 72 of plunger 60. In operation, as end cap 100 moves from its first non-actuated position to its actuated position, terminal end 108 of actuation post 106 urges plunger 60 downwardly such that terminal end 80 of needle 74 projects from first well 50.

In operation, it is contemplated to utilize microfluidic device 10 to perform a series of steps of a desired assay. More specifically, first well 50 in first layer 37 of lid 36 is loaded with a desired substance 84 such as a reagent or sample fluid and second well 54 is loaded with an absorbent 86. Membrane 82 overlaps the opening to first well 50 in first layer 37 of lid 36 and is bonded to lower surface 48 thereof to retain substance 84 in first well 50. In can be appreciated that by sealing the substance 84 in first well 50 with membrane 82, substance 84 may be pre-loaded in lid 36 for better packaging, storage and shipping.

In order to flow substance 84 into channel 24 through base 11 of microfluidic device 10, channel 24 is filled with a predetermined fluid. Lid 36 is positioned on base 11 such that: 1) lower surface 48 of first layer 37 of lid 36 is bought into contact with or adjacent to upper surface 20 of base 11; 2) output port 52 in first layer 37 of lid 36 is aligned with and brought into close proximity with input port 28 in base 11; and 3) input port 56 in first layer 37 of lid 36 is aligned with and brought into close proximity with output port 32 of base 11 such that absorbent 86 in second well 54 contacts the fluid in channel 24 at output port 32. Thereafter, end cap 100 is moved from its non-actuated position to its actuated position, as heretofore described. Referring to FIG. 3, as end cap 100 is moved from its non-actuated position to its actuated position, terminal end 80 of needle 74 is urged downwardly so as to pierce membrane 82 therewith and urge substance 84 from first well 50 into input port 28 of channel 24. It can be understood that as absorbent 86 in second well 54 contacts the predetermined fluid in channel 24 at output port 32, the flow of substance 84 into channel 24 is induced.

Alternatively, in order to induct the flow of substance 84 into channel 24, absorbent 86 in second well 54 may be removed and an input of a capillary (not shown) may be provided in communication with second well 54. The output of the capillary is operatively connected to a pumping mechanism (not shown). As such, as end cap 100 is moved from its non-actuated position to its actuated position, terminal end 80 of needle 74 is urged downwardly so as to pierce membrane 82 therewith and urge substance 84 from first well 50 into input port 28 of channel 24. As substance 84 is urged into channel 24, it can be understood that predetermined fluid in channel 24 will be urged into second well 54. Thereafter, the predetermined fluid in second well 54 initiates the pumping mechanism so as to initiate fluid flow in channel 24.

Once a step of the assay has been completed and entirely of substance 84 in first well 50 of lid 36 flows into channel 24, lid 36 may be removed from base 11 of microfluidic device 10 and discarded. Thereafter, for each step of the assay, a new lid 36 may placed on base 11, as heretofore described, and end cap 100 urged to its actuated position to trigger operation of microfluidic device 10, as heretofore described.

Figure 4:
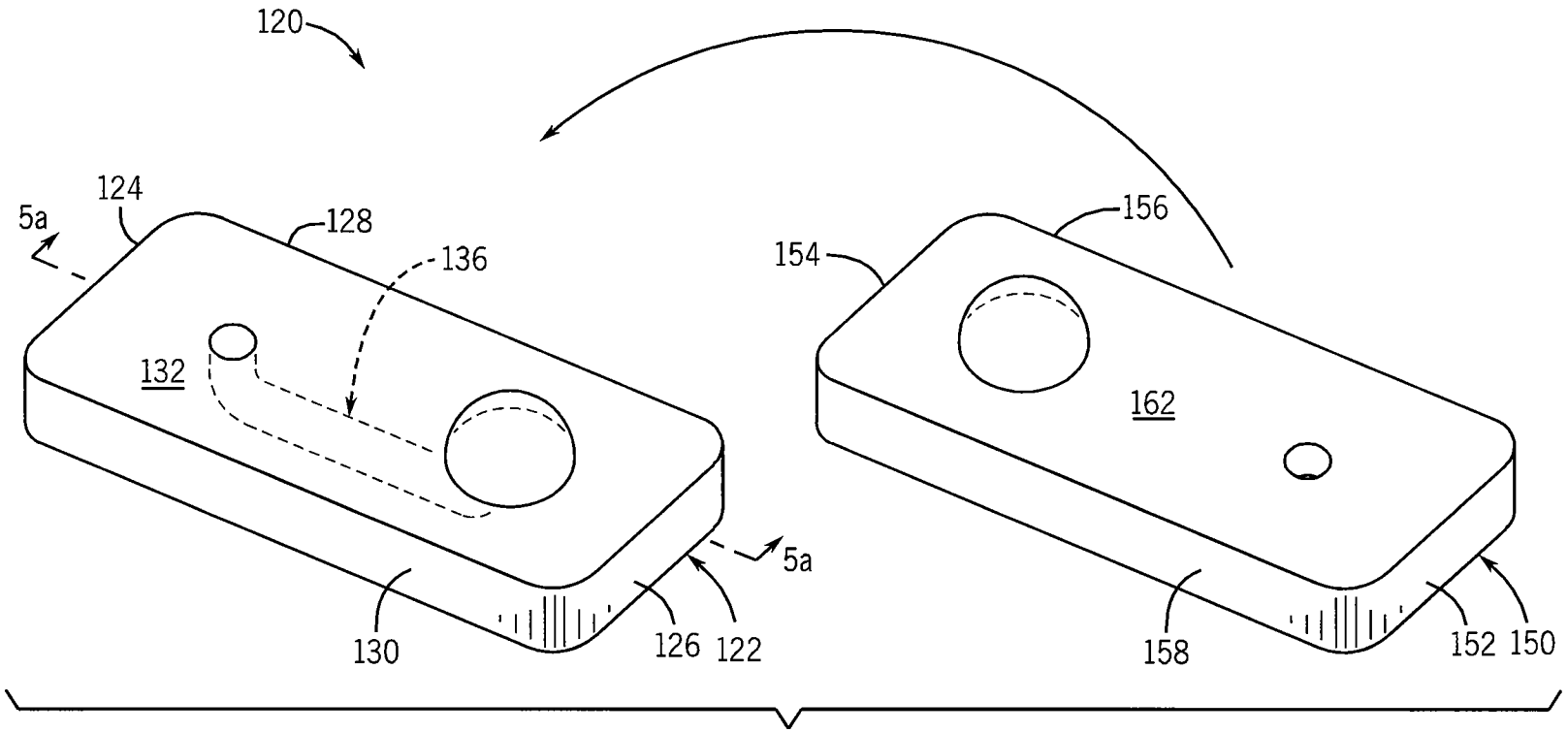
FIG. 4 is an exploded, isometric view of an alternate embodiment of a microfluidic device in accordance with the present invention.
Figure 5A:
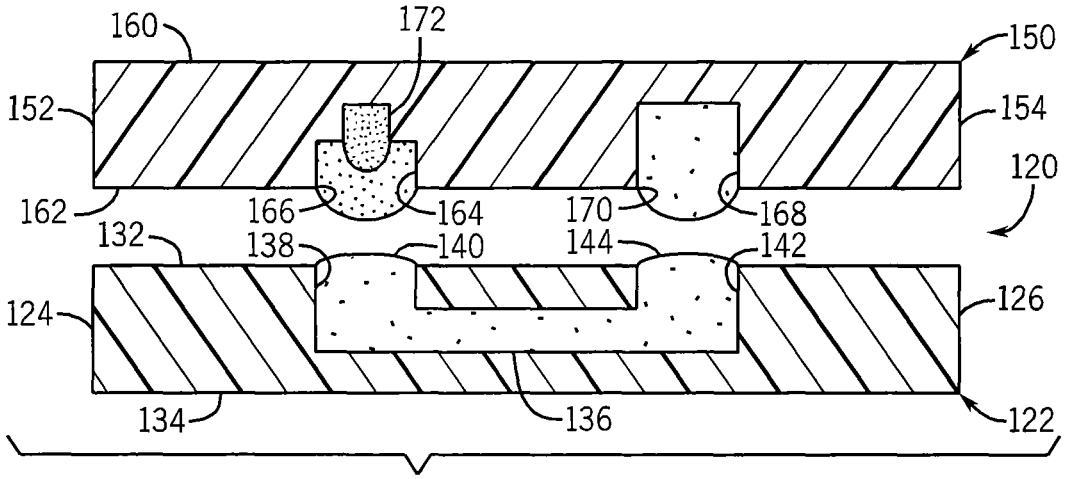
FIG. 5*a* is a cross sectional view of the microfluidic device of FIG. 4 in a non-actuated position.
Figure 5B:
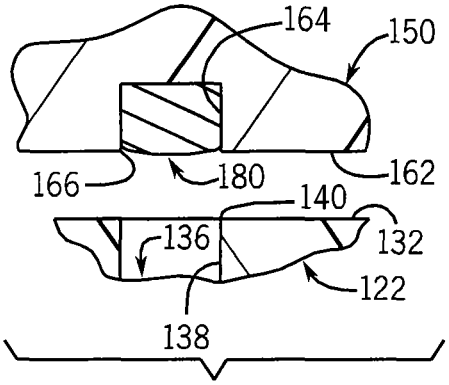
FIG. 5*b* is an enlarged, cross sectional view showing a portion of a first alternate arrangement of the microfluidic device of the present invention in a non-actuated position.
Figure 5C:
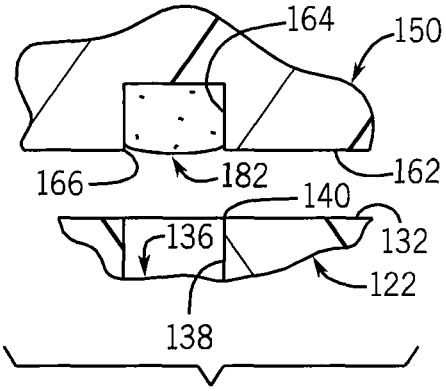
FIG. 5*c* is an enlarged, cross sectional view showing a portion of a second alternate arrangement of the microfluidic device of the present invention in a non-actuated position.
Figure 5D:
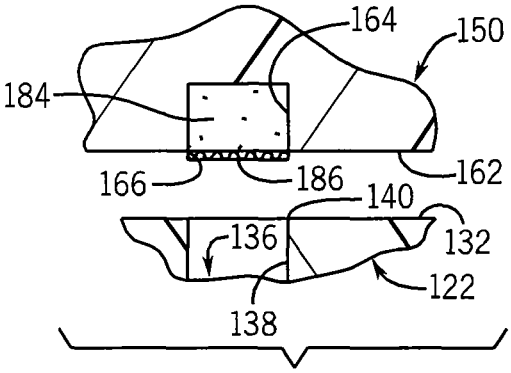
FIG. 5*d* is an enlarged, cross sectional view showing a portion of a third alternate arrangement of the microfluidic device of the present invention in a non-actuated position.
Figure 5E:
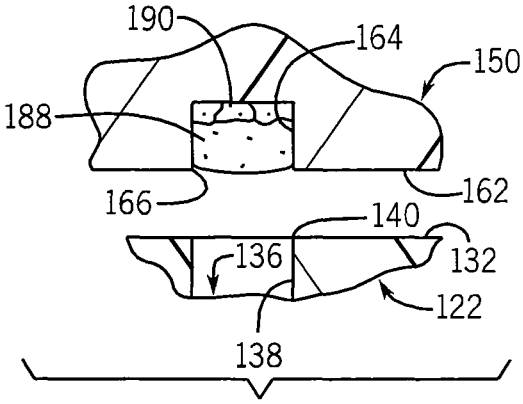
FIG. 5*e* is an enlarged, cross sectional view showing a portion of a fourth alternate arrangement of the microfluidic device of the present invention in a non-actuated position.
Figure 6:
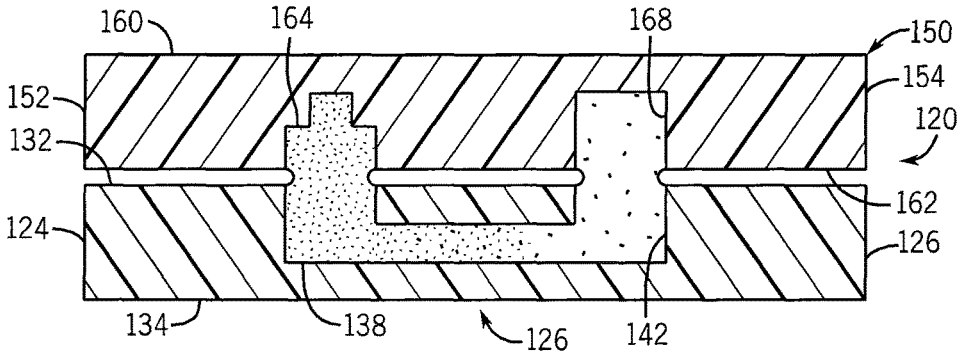
FIG. 6 is a cross sectional view of the microfluidic device of FIG. 5 in an actuated position.
Figure 8:
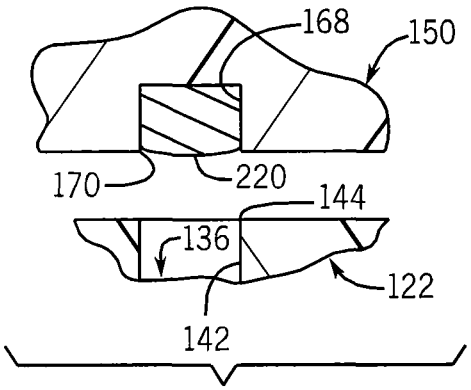
FIG. 8 is an enlarged, cross sectional view showing a portion of a fifth alternate arrangement of the microfluidic device of the present invention in a non-actuated position.

Referring to FIGS. 4-6, an alternate embodiment of a microfluidic device in accordance with the present invention is generally designated by the reference numeral 120. Microfluidic device 120 may be formed from polystyrene (PS), however, other materials are contemplated as being within the scope of the present invention. In the depicted embodiment, microfluidic device 120 includes base 122 having first and second ends 124 and 126, respectively; first and second sides 128 and 130, respectively; and upper and lower surfaces 132 and 134, respectively. Channel 136 extends through base 122 of microfluidic device 120 and includes a first vertical portion 138 terminating at an input port 140 that communicates with upper surface 132 of base 122 of microfluidic device 120 and a second vertical portion 142 terminating at an output port 144 also communicating with upper surface 132 of base 122 of microfluidic device 120. First and second vertical portions 138 and 142, respectively, of channel 136 are interconnected by and communicate with horizontal portion 146 of channel 136. It can be appreciated that the diameter of output port 144 is substantially greater than the diameter of input port 140, for reasons hereinafter described. As best seen in FIG. 8, in an alternate embodiment, it is contemplated for post 145 to project from upper surface 132 of base 122, for reasons hereinafter described.

Microfluidic device 120 further includes lid 150 with first and second ends 152 and 154, respectively; first and second sides 156 and 158, respectively; and upper and lower surfaces 160 and 162, respectively. Similar to base 122, lid 150 may be formed from polystyrene (PS), however, other materials are contemplated as being within the scope of the present invention. Lid 150 further includes a first well 164 terminating at an output port 166 that communicates with lower surface 162 and a second well 168 terminating at an input port 170 communicating with lower surface 162. The diameter of output port 166 is generally equal to the diameter of input port 140 in base 122 and the diameter of input port 170 is generally equal to the diameter of output port 144 in base 122.

As hereinafter described, cells, drugs, chemical treatments and gradients can be applied to channel 136 without flow by leveraging diffusion. More specifically, cells or a desired drug/reagent is mixed with a porous media such as a hydrogel to sequester compounds of interest therein and this "desired substance" is loaded into first well 164 in lid 150, FIG. 5*a*. It is noted that substance 172 may be preloaded in first well 164 in lid 150 for better packaging, storage and shipping. For example, substance 172 may be sealed, if desired, in first well 164 of lid 150 in a variety of manners such as by a removable and/or a protective membrane.

Referring to FIG. 6, channel 136 is filled with a predetermined fluid and lid 150 is positioned on base 122 such that: 1) lower surface 162 of lid 150 is bought into contact with or adjacent to upper surface 132 of base 122; 2) output port 166 of lid 150 is aligned with and brought into close proximity with input port 140 in base 122; and 3) input port 170 of lid 150 is aligned with and brought into close proximity with output port 144 of base 122. Once the hydrogel in first well 164 establishes fluid contact with the content of channel 136, the cells or drug/reagent particles in the hydrogel diffuse into the predetermined fluid in channel 136. In the case of drug/reagent particles, after the predetermined time period, a concentration gradient may be created along the length of channel 136 by providing source and sink regions (i.e., input port 140 and output port 144, respectively) with volumes significantly larger that the volume of channel 136. More specifically, the large volume at output port 144 of base 122 helps maintain the concentration gradient in channel 136 by not allowing the particles to accumulate therein. Without a large volume reservoir such as output port 144, the particles diffusing into channel 136 and the concentration gradient in channel 136 would not reach a pseudo-steady state value.

It can be appreciated that microfluidic device 120 of the present invention allows a user to efficiently generate a gradient in a simple straight channel allowing a user to measure the chemotaxis of cells in channel 136 in response thereto. Further, it can be appreciated that a user has the ability to manipulate fluids in channel 136 of base 122 before applying the gradient. Alternatively, by simply removing lid 150 from base 122 and washing the fluid out of channel 136, a user can remove the gradient therefrom, thereby allowing for performance of subsequent operations on a sample in channel 136 of base 122 of microfluidic device 120.

Referring to FIGS. 5*b*-5*c*, alternate embodiments are provided for diffusing a compound into channel 136. More specifically, it is contemplated replace substance 172 with either pad 180 saturated with a diffusive compound, FIG. 5*b*, or viscous fluid 182 loaded with the diffusive compound, FIG. 5*c*. As such, pad 180 or viscous fluid 182 is received in first well 164 of lid 150. Thereafter, lid 150 is positioned on base 122, as heretofore described, such that: 1) lower surface 162 of lid 150 is bought into contact with or adjacent to upper surface 132 of base 122; 2) output port 166 of lid 150 is aligned with and brought into close proximity with input port 140 in base 122; and 3) input port 170 of lid 150 is aligned with and brought into close proximity with output port 144 of base 122. Once pad 180 or viscous fluid 182 in first well 164 establishes fluid contact with the content of channel 136, the diffusive compound in pad 180 or viscous fluid 182 diffuses into the predetermined fluid in channel 136.

Figure 9:
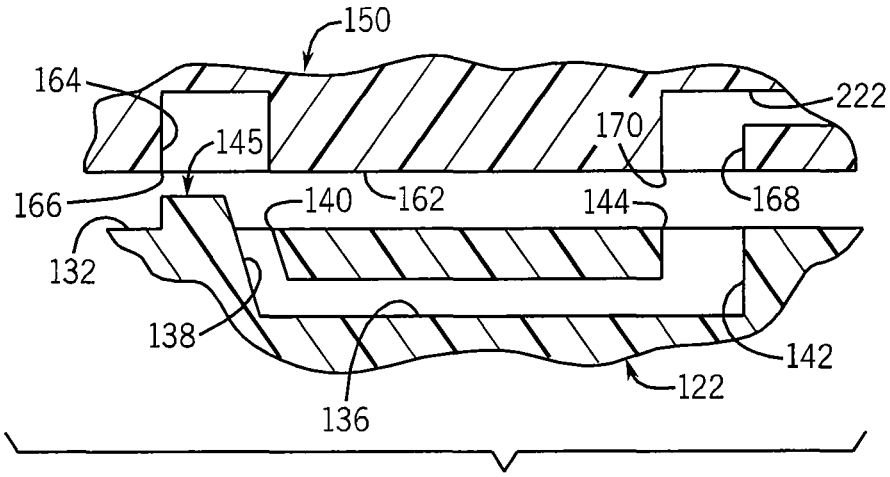
FIG. 9 is an enlarged, cross sectional view showing a portion of a sixth alternate arrangement of the microfluidic device of the present invention in a non-actuated position.

Referring to FIG. 9, in order to urge viscous fluid 182 from first well 164 of lid 150 and into channel 136, post 145 may be provided. As lid 150 is positioned on base 122, it is contemplated for post 145 projecting from upper surface 132 of base 122 to be received into first well 164 through output port 166. It can be appreciated that as post 145 enters first well 164, viscous fluid 182 is urged from first well 164 and into channel 136 through output port 144.

Alternatively, referring to FIG. 5*d*, fluid 184 loaded with the diffusive compound, FIG. 5*c*, may be received in first well 164 of lid 150. Fluid 184 is sealed in first well 164 of lid 150 by porous membrane 186. Thereafter, lid 150 is positioned on base 122, as heretofore described, such that: 1) lower surface 162 of lid 150 is bought into contact with or adjacent to upper surface 132 of base 122; 2) output port 166 of lid 150 is aligned with and brought into close proximity with input port 140 in base 122; and 3) input port 170 of lid 150 is aligned with and brought into close proximity with output port 144 of base 122. Once membrane 186 establishes fluid contact with the content of channel 136, the diffusive compound in fluid 184 diffuses through membrane 186 into the predetermined fluid in channel 136. Again, post 145 may be provided to urge fluid 184 from first well 164 and into channel 136, as heretofore described. Alternatively, membrane 186 may be non-porous and include hole 187 for facilitating the flow of fluid 184 from first well 164 into channel 136 therethough, FIG. 9. As such, post 145 may be provided to engage membrane 186 urge fluid 184 from first well 164 through hole 187 and into channel 136, as heretofore described Referring to FIG. 5*e*, it is further contemplated to provide cell culture media 188 loaded with cells 190 in first well 164 of lid 150. Thereafter, lid 150 is positioned on base 122, as heretofore described, such that: 1) lower surface 162 of lid 150 is bought into contact with or adjacent to upper surface 132 of base 122; 2) output port 166 of lid 150 is aligned with and brought into close proximity with input port 140 in base 122; and 3) input port 170 of lid 150 is aligned with and brought into close proximity with output port 144 of base 122. Once cell culture media 188 establishes fluid contact with the content of channel 136, cells 190 in cell culture media 188 diffuse into the predetermined fluid in channel 136.

Figure 7:
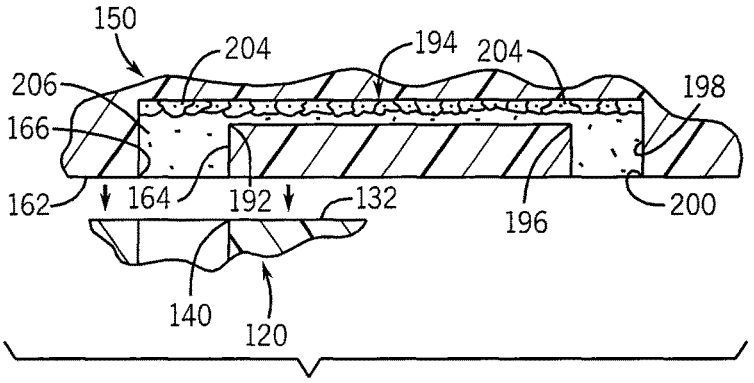
FIG. 7 is an enlarged, cross sectional view showing an alternate embodiment of a lid for the microfluidic device of the present invention in a non-actuated position.

As best seen in FIG. 7, first well 164 in lid 150 may be in communication with first end 192 of channel 194 extending through lid 150. Second end 196 of channel 194 communicates with loading well 198 which terminates at input 200. Input 200 of loading well 198 communicates with lower surface 162 of lid 150. It is contemplated for the absolute value of the radius of curvature of output port 166 to be greater than the absolute value of the radius of curvature of input 200 such that the pressure at output port 166 is essentially zero. As a drop is deposited on input 200, a pressure gradient is generated so as to cause the drop to flow from input 200 through channel 194 to output port 166. It can be understood that by sequentially depositing additional drops on input 200, the resulting pressure gradient will cause the drops to flow to output port 166 thereby generating fluid flow from input 200 to output port 166. It can be appreciated that using the methodology heretofore described, cells 204 may be flowed into and cultured within cell culture media 206 in channel 194.

With cells 204 cultured in channel 194, lid 150 may be positioned on base 122, as heretofore described, such that: 1)

lower surface 162 of lid 150 is bought into contact with or adjacent to upper surface 132 of base 122; 2) output port 166 of lid 150 is aligned with and brought into close proximity with input port 140 in base 122; and 3) input port 170 of lid 150 is aligned with and brought into close proximity with output port 144 of base 122. Once cell culture media 206 establishes fluid contact with the content of channel 136, cells 204 in channel 194 diffuse into the predetermined fluid in channel 136.

Referring to FIG. 8, in order to facilitate fluid flow in channel 136, it is contemplated to provide absorbent 220 in second well 168. It can be appreciated that with lid 150 positioned on base 122 as heretofore described, absorbent 220 contacts the predetermined fluid in channel 136 at output port 144 such that fluid flow within channel 136 is induced. Alternatively, in order to induct fluid flow in channel 136, absorbent 220 in second well 168 may be removed and an input of capillary 222 may be provided in communication with second well 168, FIG. 9. The output of capillary 222 is operatively connected to a pumping mechanism (not shown).

In operation, lid 150 is positioned on base 122, as heretofore described, such that: 1) lower surface 162 of lid 150 is bought into contact with or adjacent to upper surface 132 of base 122; 2) output port 166 of lid 150 is aligned with and brought into close proximity with input port 140 in base 122; and 3) input port 170 of lid 150 is aligned with and brought into close proximity with output port 144 of base 122. As lid 150 is positioned on base 122, it is contemplated for post 145 projecting from upper surface 132 of base 122 to be received into first well 164 through output port 166. It can be appreciated that as post 145 engages membrane 186 and urges membrane 186 into first well 164, the fluid therein is urged from first well 164 through hole 187; through channel 136, output port 144 and second well 168 in lid 150; and into the input of capillary 222. Thereafter, the predetermined fluid in communication with the input of capillary 222 initiates the pumping mechanism to maintain fluid flow in channel 136. It can be appreciated that first vertical portion 138 of channel 136 in base 122 acts as a collection funnel to capture the fluid received from first well 164 in lid 150.

An additional contemplated application of the present invention is to provide a kit incorporating microfluidic device 10 wherein an end user can place biomaterial of choice (cells, tissues, etc) in channel 136 of base 122. A series of lids may be provided in the kit for acting on the biomaterial in channel 136. For example, the series of lids may be used for a variety of purposes, such as gradient chemotaxis; to contain the biomaterial; and/or for drug treatment. After the end user manipulates the biomaterial as desired, a series of additional lids may be provided that allow the end user to complete an entire immunostaining protocol without the need for pipettes. These lids would contain liquids, including the antibodies and fluorophores, needed for detection. The end user would effectuate the protocol by applying the lids, as heretofore described, in a specified sequence. This application allows for higher throughput, cheaper costs, and faster protocol times.

Microfluidic device 120 maybe also be used to study leukocyte adhesion. As is known, leukocyte adhesion is critical for proper immune responses to sites of wound or infection. Too much or too little adhesion is a hallmark for a variety of pathologies including leukocyte adhesion deficiency (LAD) and vasculitis. The current methods for adhesion assay require the use of multi-well plates coated with a substrate in which a patient's purified white blood cells are applied in large quantities. The cells are stimulated to adhere for period of time, and then a series of washes using large volumes and pipettes is performed to monitor the strength of cell adhesion. Using microfluidic device of the present invention, a platform is provided in which small cell quantities could be used and purified in the single device. By way of example, a series of lids 150 containing the necessary wash buffers may be sequentially applied to small cell quantities in channel 136 of base 122 of microfluidic device 120, as heretofore described. Thereafter, an end user could sequentially apply additional lids 150 to perform the adhesion assay. This would provide increased efficiency and decreased sample volumes, an attractive requisite for blood samples.

Referring to FIGS. 10-17, an alternate embodiment of a microfluidic device in accordance with the present invention is generally designated by the reference numeral 300. Microfluidic device 300 may be formed from polystyrene (PS) or polydimethylsiloxane (PDMS), however, other materials are contemplated as being within the scope of the present invention. In the depicted embodiment, microfluidic device 300 includes base 302 having first and second ends 304 and 306, respectively; first and second sides 308 and 310, respectively; and upper and lower surfaces 312 and 314, respectively, FIGS. 10-11 and 14-15. A plurality of axially aligned wells, generally designated by the reference numeral 316, are provided in base 302, FIGS. 11-12. Each of the plurality of wells 316 includes port 318 communicating with upper surface 312 of base 302 of microfluidic device 300. Trough 320 extends along an axis generally parallel to and spaced from the axis along which the plurality of wells 316 are spaced. Trough 320 opens to upper surface 312 of base 302 of microfluidic device 300 and is adapted for receiving absorbent 322 therein, for reasons hereinafter described.

Figure 10:
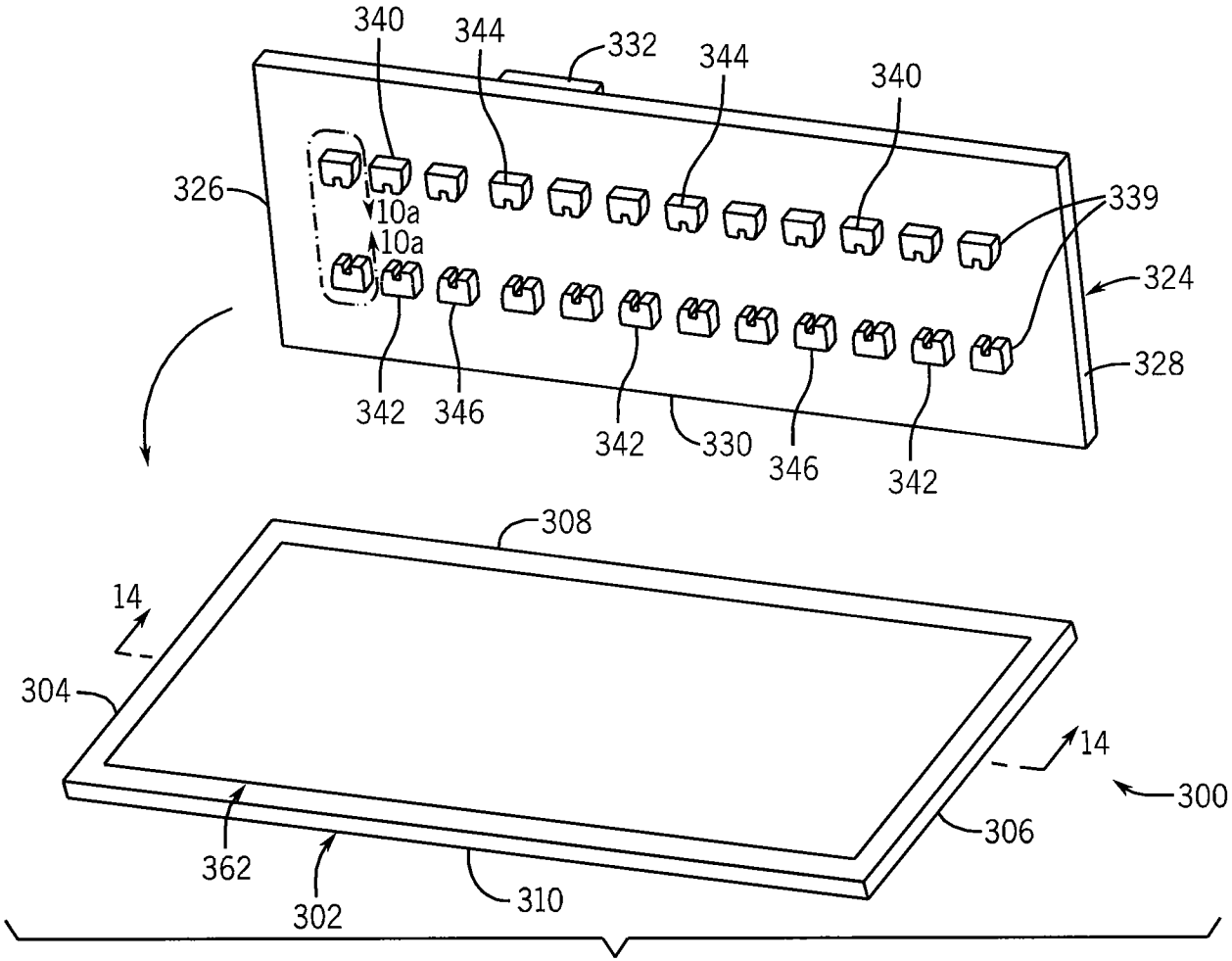
FIG. 10 is an exploded, isometric view of an alternate embodiment of a microfluidic device in accordance with the present invention.
Figure 10A:
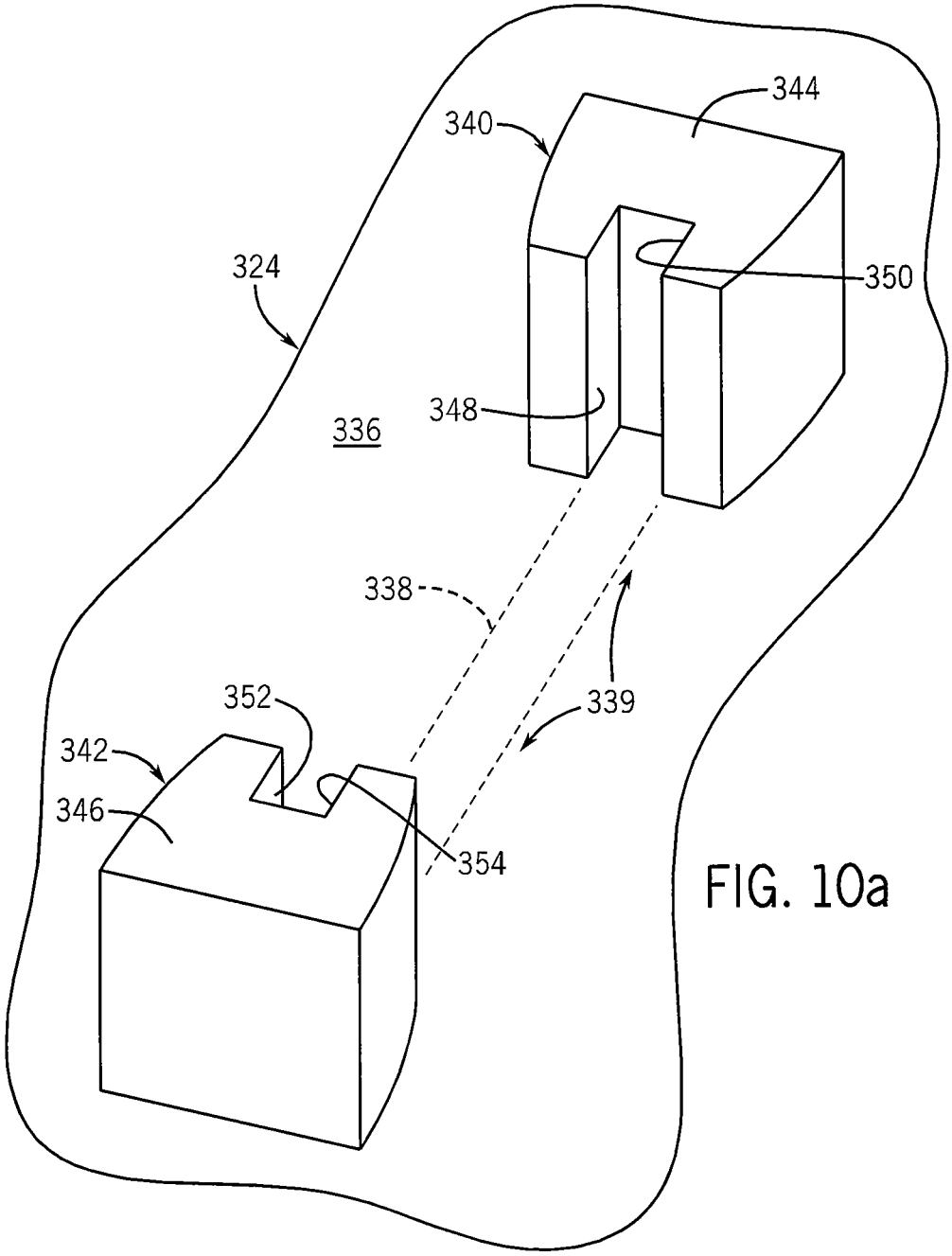
FIG. 10*a* is an enlarged, isometric view of the microfluidic device of the present invention taken along line 10*a*-10*a* of FIG. 10.
Figure 11:
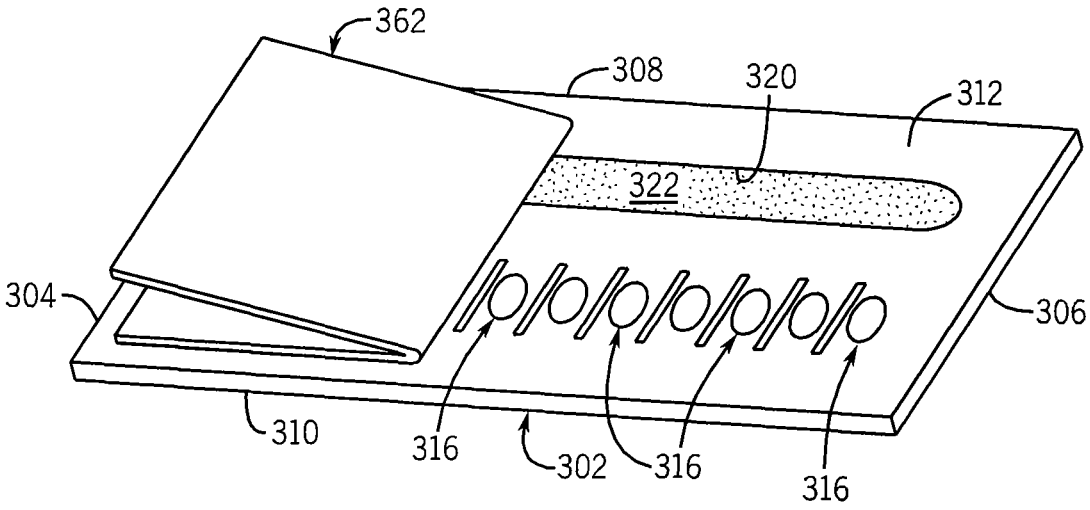
FIG. 11 is an isometric view of a base for the microfluidic device of FIG. 10.
Figure 12:
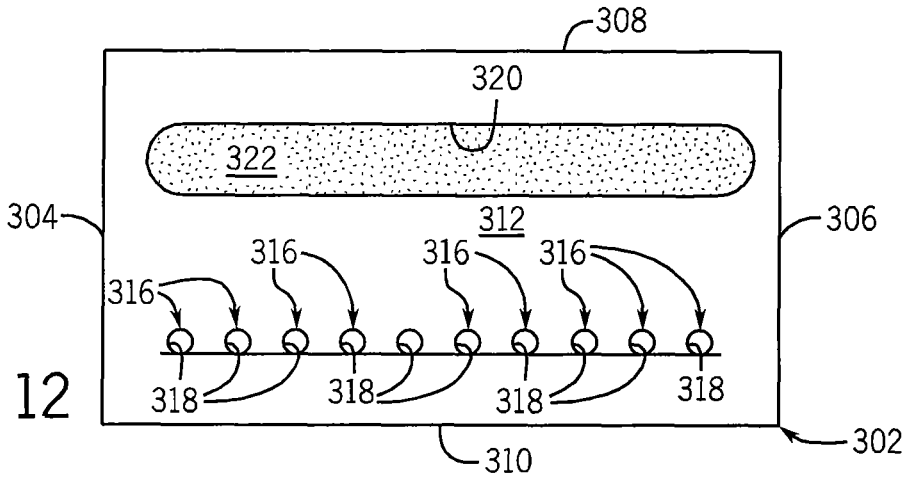
FIG. 12 is a top plan view of the base of FIG. 11.

Microfluidic device 300 further includes lid 324 having first and second ends 326 and 328, respectively; first and second sides 330 and 332, respectively; and upper and lower surfaces 334 and 336, respectively. Similar to base 302, lid 324 may be formed from polystyrene (PS), however, other materials are contemplated as being within the scope of the present invention. A plurality of input and output projection pairs, generally designated by the reference numeral 339, extend from lower surface 336 of lid 324. As best seen in FIG. 10*a*, each pair of input and output projections pairs 339 includes an input projection 340 and an output projection 342 which terminate at corresponding end surfaces 344 and 346, respectively. Input projection 340 and output projection 342 of each pair are axially spaced the same distance as between trough 320 and the axis along which the plurality of wells 316 extend. Channels 338 extends through lid 324 of microfluidic device 300 and includes first vertical slot portions 348 terminating at corresponding input ports 350 that communicates with end surfaces 344 of corresponding input projections 340 and second vertical slot portions 352 terminating at corresponding output ports 354 communicating with end surfaces 346 of corresponding output projections 342. First and second vertical slot portions 348 and 352, respectively, of each channel 338 open to the outer surfaces of input and output projections 340 and 342, respectively, and are interconnected by and communicate with horizontal portions 356 of corresponding channels 338. The dimensions of channels 338 connecting input ports 350 and output ports 354 are arbitrary. It is intended for input port 350 of each input projection 340 and output port 354 of each output projection 342 be dimensioned so as to form a mating relationship with a corresponding port 318 of one of the plurality of wells 316 and trough 320, respectively.

Figure 16:
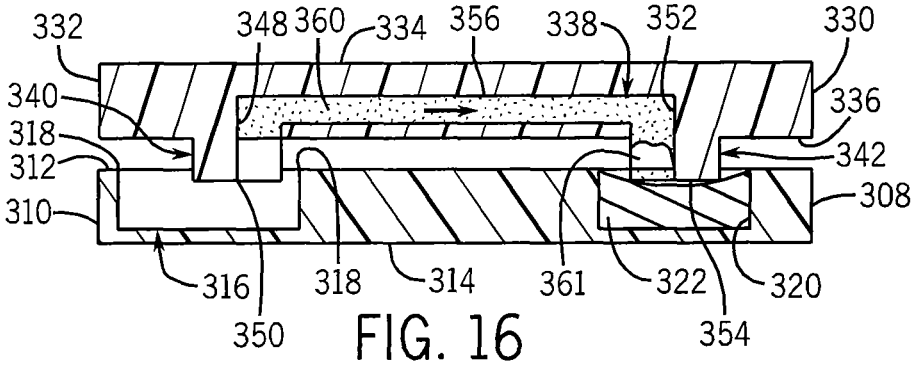
FIG. 16 is a cross sectional view of the microfluidic device of FIG. 15 in a filled configuration.
Figure 17:
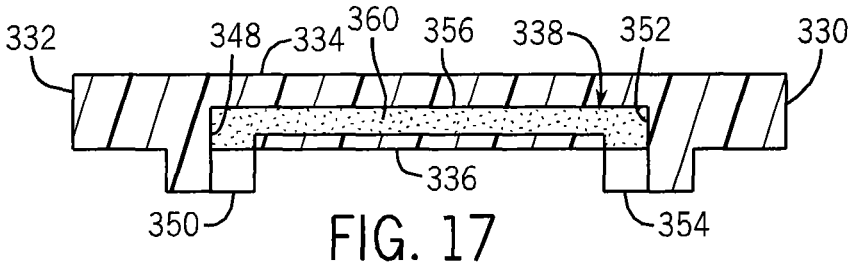
FIG. 17 is a cross sectional view of a lid of the microfluidic device of FIG. 10 in a filled configuration.

In operation, the plurality of wells 316 in base 302 are filed with a desired substance 360, such as a reagent or the like. Thereafter, membrane 362 is bonded to upper surface 312 of base 302 so as to overlap ports 318 of the plurality of wells 316 to hermetically isolate the interior of the plurality of wells 316 for storage and transport, FIG. 10. In order to draw substance 360 in the plurality of wells 316 into channels 338 in lid 324, membrane 362 is removed from upper surface 312 of base 302, FIG. 11. Lid 324 is then positioned on base 302 such that: 1) lower surface 336 of lid 324 is bought adjacent to upper surface 312 of base 302; 2) input ports 350 in lid 324 are aligned with and brought into close proximity with corresponding ports 318 in base 302 such that substances 360 in wells 316 are in fluid communication with corresponding channels 338; and 3) output ports 354 in lid 324 are aligned with and brought into close proximity absorbent 322 in trough 320 of base 302 such that absorbent 322 is in fluid communication with corresponding channels 338, FIG. 12. With lid 324 positioned as described, capillary action draws substance 360 from the plurality of wells 316 into channels 338 in lid 324, FIG. 15. Absorbent 322 in trough 320 drives fluid flow in channels 338 thereby minimizing the effort required for the loading of substance 360 in channels 338 and significantly reducing waste of such substance since only the substance needed is used. It can be appreciated that slots 352 in output ports 354 in lid 324 allow air 361 to be received in slots 352 while maintaining a liquid connection between absorbent 322 and substances 360 in wells 316. In other words, if substances 360 remain in wells 316, capillary action will continue to draw substances 360 from the plurality of wells 316 through channels 338 in lid 324 to absorbent 322. Referring to FIG. 16, once wells 316 have been emptied and substances 360 have been completely drawn into channels 338, the volume of air 361 in slots 352 increases so as to break the fluid connections between absorbent 322 and channels 338. As a result, substances 360 in channels 338 are retained therein. Since channels 338 in lid 324 are loaded simultaneously, the time required for loading such channels is significantly reduced. With channels 338 filled with substance 360, FIG. 17, lid 324 may be removed from base 302 for further processing.

Figure 13:
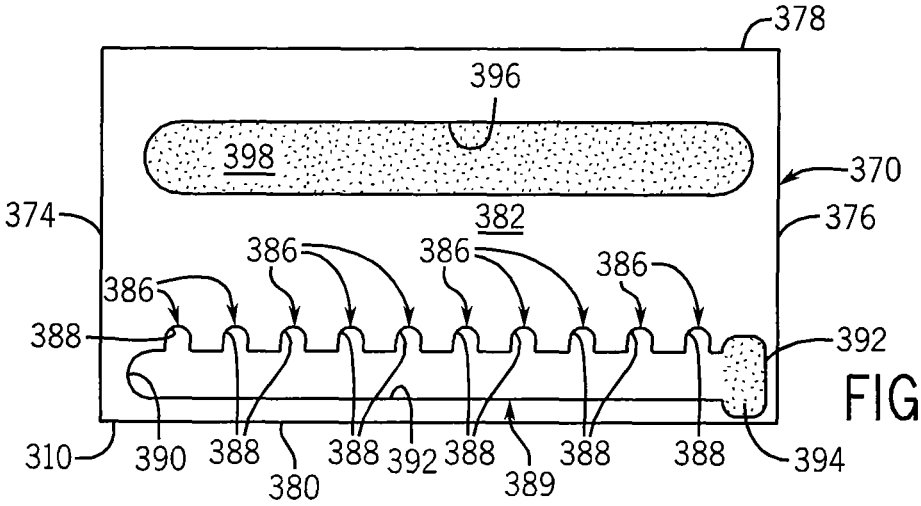
FIG. 13 is a top plan view of an alternate embodiment of the base of FIG. 11.
Figure 14:
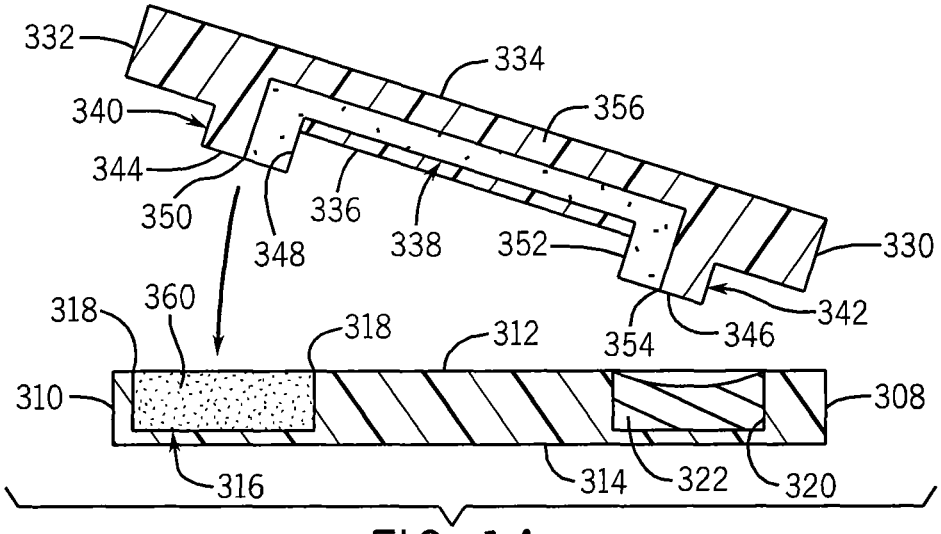
FIG. 14 is a cross sectional view of the microfluidic device of FIG. 10 in a disengaged configuration.
Figure 15:
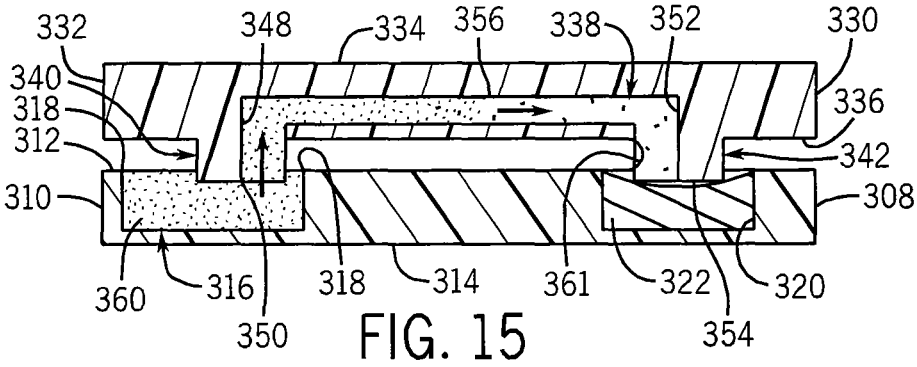
FIG. 15 is a cross sectional view of the microfluidic device of FIG. 14 in an engaged configuration.

Referring to FIG. 13, in order to further reduce the time associated with loading of channels 338 in lid 324, microfluidic device 300 may be provided with an alternate base, generally designated by the reference numeral 370. Base 370 includes first and second ends 374 and 376, respectively; first and second sides 378 and 380, respectively; and upper surface 382. A plurality of axially aligned wells, generally designated by the reference numeral 386, are provided in base 370. Each of the plurality of wells 386 includes port 388 communicating with upper surface 382 of base 370 of microfluidic device 300.

Base 370 further includes a fill channel 389 extending along an axis generally parallel to the axis along which the plurality of wells 386 are spaced. Fill channel 389 includes an inlet 390 at a first end thereof and a fill trough 392 disposed on a second opposite end of thereof. Fill trough 392 is adapted for receiving absorbent 394 therein, for reasons hereinafter described. Each of the plurality of wells 386 is interconnected to fill channel 389 by corresponding sub-channels 391. Second trough 396 extends along an axis generally parallel to and spaced from the axis along which the plurality of wells 386 are spaced. Second trough 396 opens to upper surface 382 of base 370 of microfluidic device 300 and is also adapted for receiving absorbent 398 therein, for reasons hereinafter described.

In order to fill the plurality of wells 386 in base 302 with a desired substance 360, such as a reagent or the like, substance 360 is deposited into inlet 390 of fill channel 389 so as to flow therein. Substance 360 fills fill channel 389 and flows into each of the plurality of wells 386 through sub-channels 391. Thereafter, absorbent 398 draws in and captures the remaining substance 360 in fill channel 389 such that fill channel 389 is emptied. Lid 324 is then positioned on base 370 such that: 1) lower surface 336 of lid 324 is bought adjacent to upper surface 382 of base 370; 2) input ports 350 in lid 324 are aligned with and brought into close proximity with corresponding ports 388 in base 370 such that substances 360 in the plurality of wells 386 are in fluid communication with corresponding channels 338; and 3) output ports 354 in lid 324 are aligned with and brought into close proximity absorbent 398 in second trough 396 of base 370 such that absorbent 398 is in fluid communication with corresponding channels 338.

With lid 324 positioned as described, capillary action draws substance 360 from the plurality of wells 386 into channels 338 in lid 324. Absorbent 398 in trough 396 drives fluid flow in channels 338 thereby minimizing the effort required for the loading of substance 360 in channels 338 and significantly reducing waste of such substance since only the substance needed is used. It can be appreciated that slots 352 in output ports 354 in lid 324 allow air 361 to be received in slots 352 while maintaining a liquid connection between absorbent 398 and substances 360 in wells 3 ports 318. Once wells 386 have been emptied and substances 360 have been completely drawn into channels 338, the volume of air 361 in slots 352 increases so as to break the fluid connections between absorbent 398 and channels 338. As a result, substances 360 in channels 338 are retained therein. As previously noted, because channels 338 are loaded simultaneously, the time required for such loading is significantly reduced. With channels 338 filled with substance 360, FIG. 17, lid 324 may be removed from base 370 for further processing.

Various modes of carrying out the invention are contemplated as being within the scope of the following claims particularly pointing out and distinctly claiming the subject matter that is regarded as the invention.

We claim:

1. A microfluidic platform, comprising:

a base having:

an outer surface;

a well formed in the outer surface of the base for receiving a fluid therein, the well having an open end communicating with the outer surface of the base and being configured to allow the fluid to flow therepast, and a closed end being configured to prevent the fluid from flowing therepast; and a recess in the outer surface of the base at a location spaced from the well, the recess having an open end communicating with the outer surface of the base and being configured to allow the fluid to flow therepast, and a closed end being configured to prevent the fluid from flowing therepast;

an absorbent received in the recess in the base;

a lid having an interior, an outer surface and a channel extending through the interior and being spaced from the outer surface of the lid;

an input port projecting from the outer surface of the lid, terminating at an end surface and having a passageway therethrough, the passageway of the input port having a first end communicating an input of the channel and a second end communicating with the end surface of the input port; and an output port projecting from the outer surface of the lid and terminating at an end surface, the output port having:

a passageway extending therethrough, the passageway of the output port having a first end communicating with an output of the channel and a second end communicating with the end surface of the output port; and an output outer surface of the output port having a slot therein extending between the outer surface of the lid and the end surface of the output port, the slot communicating with the passageway of the output port;

wherein:

the lid selectively moveable between a first position wherein the input port projecting from the lid is disengaged from the base and a second position wherein:

the outer surface of the lid and the outer surface of the base are in spaced relation wherein the slot in the output outer surface of the output port communicates with an environment external of the lid and the base;

the fluid is allowed to pass through the slot in the output outer surface of the output port extending from the lid; and the input of the channel communicates with the fluid in the well through the passageway of the input port and the output of the channel communicates with the absorbent in the recess through the passageway of the output port;

wherein:

with the lid in the second position:

the second end of the input port communicates with the fluid in the well of the base such that the fluid in the well is drawn into the passageway of the input port by capillary action;

the absorbent drives fluid flow from the well into the passageway of the input port through the channel in the lid and into the passageway of the output port; and the slot in the output outer surface of the output port allows for the environment to be received in the slot while allowing for a fluid connection between the absorbent and the fluid in the well.

2. The microfluidic platform of claim 1 further comprising a removable membrane connected to the outer surface of the base and extending over the well for retaining the fluid therein.

3. The microfluidic platform of claim 1 wherein the input port defines a post, the post receivable in the well with the lid in the second position.

4. A microfluidic platform, comprising:

a base having:

an outer surface;

a plurality of wells formed in the outer surface of the base for receiving fluid therein, each well of the plurality of wells having an open end in fluid communication with the outer surface of the base and being configured to allow the fluid to flow therepast, and a closed end being configured to prevent fluid from flowing therepast; and at least one recess in the outer surface of the base at a location spaced from the plurality of wells, each of the at least one recess having an open end communicating with the outer surface of the base and being configured to allow the fluid to flow therepast, and a closed end being configured to prevent the fluid from flowing therepast;

an absorbent received in the at least one recess in the base; and a lid including an interior, an outer surface and a plurality of channels extending through the interior being spaced from the outer surface of the lid and having corresponding inputs and outputs;

input ports projecting from the outer surface of the lid and terminating at corresponding end surfaces, each input port including a passageway therethrough having a first end communicating an input of a corresponding channel of the plurality of channels and a second end communicating with the corresponding end surface; and output ports projecting from the outer surface of the lid and terminating at corresponding end surfaces, each output port having:

a passageway extending therethrough, the passageway of each output port having a first end communicating with an output of a corresponding channel of the plurality of channels and a second end communicating with the corresponding end surface; and an output outer surface of a corresponding output port having a slot therein extending between the outer surface of the lid and the end surface of the corresponding output port, the slot communicating with the passageway through the corresponding output port;

the lid is selectively moveable between a first position wherein the input ports of the lid are disengaged from the base and a second position wherein:

the outer surface of the lid and the outer surface of the base are in spaced relation wherein the slots in the output outer surfaces of the corresponding output ports of the lid communicate with an environment external of the base and the lid;

the fluid is allowed to pass through the slots in the output outer surfaces of the corresponding output ports of the lid; and the input of each channel of the plurality of channels communicates with a corresponding well of the plurality of wells in the base through the passageway of a corresponding input port and the output of each channel of the plurality of channels communicates with the absorbent in the at least one recess through the passageway of the corresponding output port;

the fluid in each well of the plurality of wells is drawn into a corresponding channel of the plurality of channels through the passageway of the corresponding input port, the input of the corresponding channel of the plurality of channels through the lid, and the passageway of the corresponding output port;

the absorbent drives fluid flow through the plurality of channels in the lid; and the slots in the output outer surfaces of the corresponding output ports allow for the environment to be received in the slots while allowing for fluid connections between the absorbent and the fluid in each well.

5. The microfluidic platform of claim 4 further comprising a removable membrane connected to the outer surface of the base and extending over the plurality of wells for retaining the fluid therein.

6. The microfluidic platform of claim 4 wherein each input port defines a post, each post receivable in the corresponding well of the plurality of wells with the lid in the second position.

* * * * *